US009314791B2

(12) United States Patent
Kim et al.

(10) Patent No.: US 9,314,791 B2
(45) Date of Patent: Apr. 19, 2016

(54) MICROFLUIDIC SYSTEM

(75) Inventors: Ji Tae Kim, Seongnam-si (KR); Gyoung Soo Kim, Ansan-si (KR); Seok Jung Hyun, Busan (KR); Guei Sam Lim, Incheon (KR); Youn Jae Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 258 days.

(21) Appl. No.: 13/331,635

(22) Filed: Dec. 20, 2011

(65) Prior Publication Data

US 2012/0152740 A1 Jun. 21, 2012

(30) Foreign Application Priority Data

Dec. 21, 2010 (KR) ..... 10-2010-0131385

(51) Int. Cl.
*B01L 3/00* (2006.01)
*B01L 99/00* (2010.01)

(52) U.S. Cl.
CPC ..... *B01L 3/502715* (2013.01); *B01L 2200/025* (2013.01); *B01L 2200/027* (2013.01); *B01L 2200/0689* (2013.01); *B01L 2300/0816* (2013.01)

(58) Field of Classification Search
CPC ..... B01L 3/502715; B01L 2200/025; B01L 2200/027; B01L 2200/0689; B01L 2300/0816
USPC ..... 422/500, 501, 502, 503, 504, 505, 542
See application file for complete search history.

(56) References Cited

U.S. PATENT DOCUMENTS

| | | | | |
|---|---|---|---|---|
| 4,648,727 | A * | 3/1987 | O'Neil et al. | 384/49 |
| 5,234,235 | A * | 8/1993 | Worden | F16L 29/04 285/334.4 |
| 6,102,449 | A * | 8/2000 | Welsh | 285/342 |
| 6,319,476 | B1 * | 11/2001 | Victor et al. | 422/502 |
| 7,553,455 | B1 * | 6/2009 | Renzi | B01L 3/502715 422/546 |
| 2003/0096081 | A1 | 5/2003 | Lavallee et al. | |
| 2003/0156993 | A1 | 8/2003 | Staats | |
| 2004/0189311 | A1 * | 9/2004 | Glezer et al. | 324/444 |
| 2009/0074623 | A1 | 3/2009 | Park et al. | |
| 2009/0253181 | A1 | 10/2009 | Vangbo et al. | |
| 2010/0159574 | A1 | 6/2010 | Shin et al. | |

OTHER PUBLICATIONS

Yang et al., Socket with built-in valves for the interconnection of microfluidic chips to macro constituents, Journal of Chromatography A, 1013 (2003) p. 29-33.*
Nittis et al., A high-pressure interconnect for chemical microsystem applications, Lab on a Chip, 2001, 1, p. 148-152.*
Guijt, Rosanne M., et al. "Conductivity detection for conventional and miniaturised capillary electrophoresis systems." Electrophoresis 25.23-24 (2004): 4032-4057.*

* cited by examiner

*Primary Examiner* — Lyle Alexander
*Assistant Examiner* — Robert Eom
(74) *Attorney, Agent, or Firm* — Birch, Stewart, Kolasch & Birch, LLP

(57) ABSTRACT

Disclosed is a micro-fluidic system including a lower substrate, an upper substrate formed opposite to the lower substrate and formed with an air injection path, and a micro-fluidic device interposed between the upper and lower substrates, wherein the micro-fluidic chamber includes a fluid chamber filled with a fluid and the fluidic chamber is physically connected to the air injection path.

10 Claims, 6 Drawing Sheets

MICROFLUIDIC SYSTEM

Pursuant to 35 U.S.C.§119 (a), this application claims the benefit of earlier filing date and right of priority to Korean Patent Application No. 10-2010-0131385, filed on Dec. 21, 2010, the contents of which is hereby incorporated by reference in their entirety.

BACKGROUND OF THE DISCLOSURE

1. Field

The teachings in accordance with the exemplary embodiments of this present invention generally relate to a micro-fluidic system.

2. Background

There has been a growing interest in the manufacture and use of micro-fluidic systems for the acquisition of chemical and biological information. In particular, when conducted in micro-fluidic volumes, complicated biochemical reactions may be carried out using very small volumes of liquid. Among other benefits, micro-fluidic systems are characterized by improved reaction response time, reduced sample volumes, and lower reagent consumption. When volatile or hazardous materials are used or generated, performing reactions in micro-fluidic volumes also enhances safety and reduces disposal quantities.

The micro-fluidic device needs a transferring operation for assaying fluid positioned inside a fluidic chamber of the micro-fluidic device. To this end, a number of fabrication methods and systems are currently under development.

SUMMARY

The present invention has been made to solve disadvantages of the prior art and therefore an object of certain embodiments of the present invention is to provide a micro-fluidic system configured to accurately control movement of fluid.

Technical subjects to be solved by the present invention are not restricted to the above-mentioned description, and any other technical problems not mentioned so far will be clearly appreciated from the following description by the skilled in the art. That is, the present invention will be understood more easily and other objects, characteristics, details and advantages thereof will become more apparent in the course of the following explanatory description, which is given, without intending to imply any limitation of the disclosure, with reference to the attached drawings.

An object of the invention is to solve at least one or more of the above problems and/or disadvantages in whole or in part and to provide at least advantages described hereinafter. In order to achieve at least the above objects, in whole or in part, and in accordance with the purposes of the invention, as embodied and broadly described, and in one general aspect of the present invention, there is provided a micro-fluidic system, the system comprising: a lower substrate; an upper substrate formed opposite to the lower substrate and formed with an air injection path; and a micro-fluidic device interposed between the upper and lower substrates, wherein the micro-fluidic chamber includes a fluid chamber filled with a fluid and the fluidic chamber is physically connected to the air injection path.

Preferably, the micro-fluidic system further comprises fastening means fastening the upper and lower substrates, wherein the fastening means includes a clamp formed on the upper substrate and a groove formed at a lateral surface of the lower substrate.

Preferably, the micro-fluidic system further comprises an elastic member between the clamp and the upper substrate.

Preferably, the elastic member separates the micro-fluidic device from the upper and lower substrates Preferably, the upper substrate includes at least two through holes, wherein guide posts each inserted into the through hole are secured to the lower substrate, and the upper substrate is formed with a bush into which the guide post is inserted.

Preferably, a ball bearing is interposed between the bush and the guide post for reducing friction.

Preferably, the air injection path is formed with a groove formed at the micro-fluidic device and a fluid chamber exposed to the groove, and the air injection path formed at the upper substrate is formed with a groove opposite to the groove formed at the micro-fluidic device, the groove of the upper substrate is positioned with an air injection pipe connected to an external air pump, and a periphery of the air injection pipe is mounted with a coil spring and a periphery of a distal end of the air injection pipe is mounted with a support unit and a blocking unit.

Preferably, the blocking unit is secured to the support unit, and a distal end of the air injection pipe is exposed to an O-ring, and the blocking unit is an O-ring or a flexible pad.

Preferably, the O-ring is discretely positioned from the groove of the micro-fluidic device, and blocks the groove if depressed to the groove of the micro-fluidic device.

Preferably, a periphery of an air injection pipe region is mounted with a stopper for restricting elasticity of the coil spring.

Preferably, the air injection path connected to the air pump performs pressing and vacuuming operations at the air pump to move the fluid inside the fluid chamber of the micro-fluidic device.

Preferably, the fluid inside the fluid chamber of the micro-fluidic device includes biological materials such as blood, urine, serum and saliva.

Preferably, the fluid chamber includes a reaction region where electrochemical reaction occurs, and the reaction region is formed with at least one electrode electrochemically measuring a reacted degree.

Preferably, the electrode includes a reference electrode, a counter electrode and a working electrode.

Preferably, a gap between the upper and lower substrates is larger than a thickness of the micro-fluidic device.

In another general aspect of the present invention, there is provided a micro-fluidic system, the system comprising: a lower substrate; an upper substrate formed opposite to the lower substrate and formed with an air injection path; and a micro-fluidic device interposed between the upper and lower substrates, wherein the micro-fluidic chamber includes a fluid chamber filled with a fluid and the fluidic chamber is physically connected to the air injection path, and the upper substrate is mounted with a transparent window for observing the micro-fluidic device.

Preferably, the micro-fluidic system further comprises fastening means fastening the upper and lower substrates, wherein the fastening means includes a clamp formed on the upper substrate and a groove formed at a lateral surface of the lower substrate.

Preferably, the micro-fluidic system further comprises an elastic member between the clamp and the upper substrate.

Preferably, the elastic member separates the micro-fluidic device from the upper and lower substrates Preferably, the upper substrate includes at least two through holes, wherein guide posts each inserted into the through hole are secured to the lower substrate, and the upper substrate is formed with a bush into which the guide post is inserted.

Particular and preferred aspects of the invention are set out in the accompanying independent and dependent claims. Features from the dependent claims may be combined with features of the independent claims and with features of other dependent claims as appropriate and not merely as explicitly set out in the claims.

Although there has been constant improvement, change and evolution of devices in this field, the present concepts are believed to represent substantial new and novel improvements, including departures from prior practices, resulting in the provision of more efficient, stable and reliable devices of this nature.

The above and other characteristics, features and advantages of the present invention will become apparent from the following detailed description, taken in conjunction with the accompanying drawings, which illustrate, by way of example, the principles of the invention. This description is given for the sake of example only, without limiting the scope of the invention. The reference figures quoted below refer to the attached drawings.

DETAILED DESCRIPTION

Figure 1:
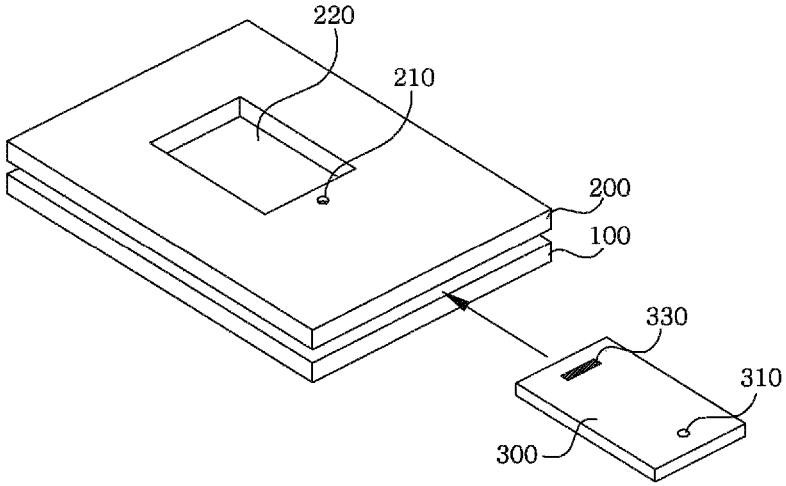
FIG. 1 is a conceptual perspective view illustrating a micro-fluidic system according to the present invention.

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn on scale for illustrative purposes. The dimensions and the relative dimensions do not correspond to actual reductions to practice of the invention.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Now, the micro-fluidic system according to exemplary embodiments of the present invention will be explained and described with reference to the accompanying drawings.

FIG. 1 is a conceptual perspective view illustrating a micro-fluidic system according to the present invention.

As used herein, the term "micro-fluidic system" is to be understood to refer to a miniaturized or micro-fluidic device for conducting chemical and biochemical analysis, otherwise known as a micro-fluidic chip, a biochip or a cartridge as a standard tool for carrying out analytical and research purposes by transferring (or in other term, pumping) fluid inside a fluidic chamber of the micro-fluidic system using air, where the fluid chamber may be called a fluidic channel, and may be also called a holder for mounting the micro-fluidic device. In other words, the term "micro-fluidic system" as used herein may refer to a micro-fluidic path, often including one or more micro-fluidic devices, capable of carrying or holding fluids. A micro-fluidic system may be composed of one or more subsystems.

The term "micro-fluidic" as used herein is to be understood to refer to structures or devices through which fluid(s) are capable of being passed or directed, wherein one or more of the dimensions is less than 500 microns, for example.

The term "flexible" as used herein means ability to endure strain, particularly due to being bent, folded, or stretched, without breaking or suffering permanent injury. "Flexible" as used herein may or may not include the further properties of being resilient or elastic.

The terms "channel" or "chamber" as used herein are not intended to be restricted to elongated configurations where the transverse or longitudinal dimension greatly exceeds the diameter or cross-sectional dimension. Rather, such terms are meant to comprise cavities or tunnels of any desired shape or configuration through which liquids may be directed. Such a fluid cavity may, for example, comprise a flow-through cell where fluid is to be continually passed or, alternatively, a chamber for holding a specified, discrete amount of fluid for a specified amount of time. "Channels" and "chambers" may be filled or may contain internal structures comprising, for example, valves, filters, and similar or equivalent components and materials.

That is, as illustrated in FIG. 1, a micro-fluidic system according to the present invention includes a lower substrate (100), an upper substrate (200) formed opposite to the lower substrate (100) and formed with an air injection path (210), a micro-fluidic device (300) interposed between the upper and lower substrates (100, 200), wherein the micro-fluidic device (300) includes a fluid chamber filled with a fluid and the fluidic chamber is physically connected to an air injection path (310).

In the micro-fluidic system according to the present invention, in a case fluid is filled in the fluid chamber of the micro-fluidic device (300), and the micro-fluidic device (300) is interposed between the upper and lower substrates (200, 100), the air injection path (310) of the micro-fluidic device (300) is integrated and interlinked with the air injection path (210) formed at the upper substrate (200).

The air injection path (210) formed at the upper substrate (200) is connected to an air pump (not shown), whereby the air pump performs pressing and vacuuming operations to move the fluid inside the fluid chamber in the micro-fluidic device (300) can be moved, and where the fluid inside the fluid chamber of the micro-fluidic device (300) may include biological materials such as blood, urine, serum and saliva.

Figure 2:
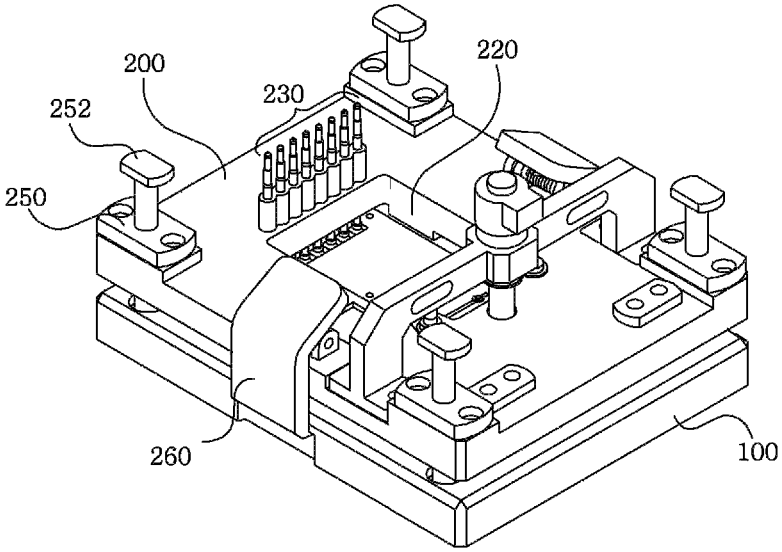
FIG. 2 is a perspective view illustrating a micro-fluidic system according to a first exemplary embodiment of the present invention.

Furthermore, the fluid chamber of the micro-fluidic device (300) is formed with a reaction region (330), whereby a degree of reacting with the fluid can be measured by an electrochemical method or an optical method. The upper substrate (200) may be formed with a window (220) through which the micro-fluidic device (300) can be observed. FIG. 2 is a perspective view illustrating a micro-fluidic system according to a first exemplary embodiment of the present invention, and FIG. 3 is a perspective view illustrating a micro-fluidic system according to a second exemplary embodiment of the present invention.

Figure 3:
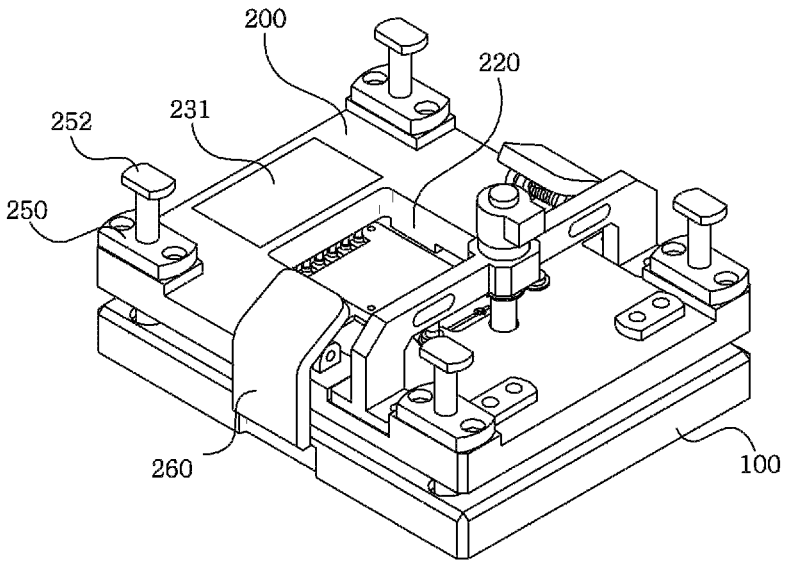
FIG. 3 is a perspective view illustrating a micro-fluidic system according to a second exemplary embodiment of the present invention.

Referring to FIGS. 2 and 3, the micro-fluidic system according to the present invention may include fastening means for fastening the upper and lower substrates (200, 100). The micro-fluidic device (300) can be inserted between the upper and lower substrates (200, 100) by using the fastening means, and the upper substrate (200) can be tightly secured to the micro-fluidic device.

The fastening means may include a clamp (260) formed on the upper substrate (200) and a groove (not shown) or a sill formed at a lateral surface of the lower substrate (100), where the clamp (260) is hitched at the sill by force applying force to a direction of the lower substrate (100) to allow the upper substrate (200) to be tightly brought into contact with the micro-fluidic device, where the micro-fluidic device is in turn secured to the upper and lower substrates (200, 100).

Furthermore, in a state where the micro-fluidic device is not inserted between the upper and lower substrates (200, 100), a gap between the upper and lower substrates (200, 100) is maintained at a predetermined distance to allow the micro-fluidic device to be smoothly inserted.

The upper substrate of the micro-fluidic system includes at least two through holes (not shown), wherein guide posts (252) each inserted into the through hole are secured to the lower substrate (100) to allow the upper substrate (200) to be smoothly moved. The upper substrate (200) is also formed with a bush (250) into which the guide post (252) is inserted. Furthermore, a ball bearing (not shown) is interposed between the bush (250) and the guide post (252) for reducing friction between the bush (250) and the guide post (252).

Meanwhile, the micro-fluidic system according to the first exemplary embodiment of the present invention is formed with electrode probes (230) capable of electrochemically measuring the fluid, as shown in FIG. 2, and the micro-fluidic system according to the second exemplary embodiment of the present invention is formed with a transparent window (231) capable of optically measuring the fluid, as depicted in FIG. 3. The transparent window (231) is formed an upper substrate (200) region capable of irradiating and reflecting light to the reaction region of the micro-fluidic device.

Figure 4A:
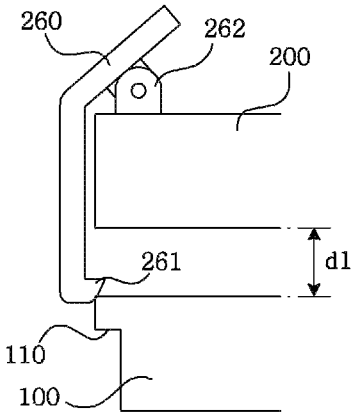
FIGS. 4*a*, 4*b* and 4*c* are partial cross-sectional views illustrating a clamp operation of a micro-fluidic system according to first and second exemplary embodiments of the present invention.
Figure 4B:
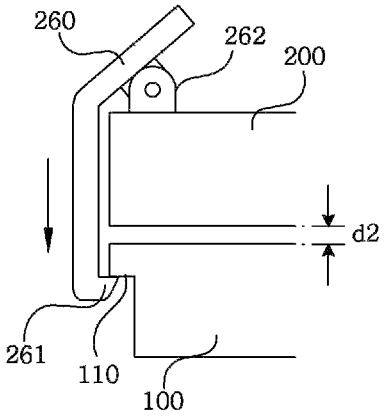
Figure 4C:
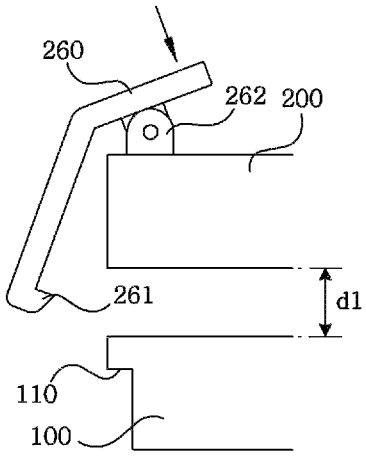

FIGS. 4*a*, 4*b* and 4*c* are partial cross-sectional views illustrating a clamp operation of a micro-fluidic system according to first and second exemplary embodiments of the present invention.

Referring to FIG. 4*a*, the clamp operation of the micro-fluidic system is such that the micro-fluidic device can be smoothly inserted between the upper and lower substrates (200, 100), because the gap (d1) between the upper and lower substrates (200, 100) is larger than thickness of the micro-fluidic device.

Thus, in a case the micro-fluidic device is inserted between the upper and lower substrates (200, 100), and the clamp (260) or the upper substrate (200) is depressed to a direction of the lower substrate (100), a hook (261) of the clamp (260) is hitched at a groove (110) of the lower substrate (100) whereby the upper substrate (200) is tightly brought into contact with the micro-fluidic device, as shown in FIG. 4*b*. Therefore, the gap between the upper and lower substrates (200, 100) is narrowed to a gap (d2).

An elastic member (262) such as a spring is preferably formed between the clamp (260) and the upper substrate (200) to separate the micro-fluidic device from the upper and lower substrates (200, 100). That is, as illustrated in FIG. 4*c*, in a case a distal end of the clamp (260) is depressed, the elastic member (262) serves as a prop of a lever to allow the hook (261) formed at the other distal end of the clamp (260) to be separated from the groove (110) of the lower substrate (100), whereby the gap (d2) between the upper and lower substrates (200, 100) is returned to the gap (d1) between the upper and lower substrates (200, 100).

Figure 5:
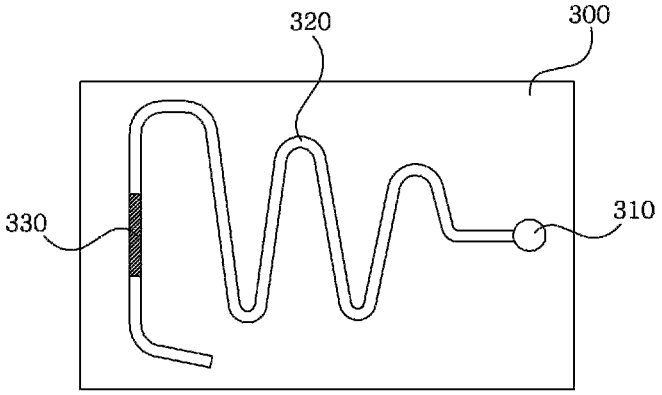
FIG. 5 is a conceptual plane view illustrating a micro-fluidic device of a micro-fluidic system according to the present invention.

FIG. 5 is a conceptual plane view illustrating a micro-fluidic device of a micro-fluidic system according to the present invention.

The micro-fluidic device includes a fluid chamber (320) capable of filling fluid and takes a shape of a chip or a cartridge formed with an air injection path (310) connected to the fluid chamber (320). Furthermore, the fluid chamber (320) may be positioned with a reaction region (330), and the reaction region (330) may be positioned with reaction inducing materials capable of reacting with the fluid filled inside the fluid chamber (320).

The reaction region (330) is formed with at least one electrode electrochemically measuring a reacted degree, and the electrodes may be positioned with reaction inducing materials, where the electrodes are a reference electrode, a counter electrode and a working electrode. Furthermore, the fluid chamber (320) may be connected to an inlet (not shown) through which the fluid can be inserted and an outlet (not shown) through which the fluid can be discharged, where the inlet and the outlet may be formed at an interior of the micro-fluidic device or at one of the upper and lower substrates.

Figure 6:
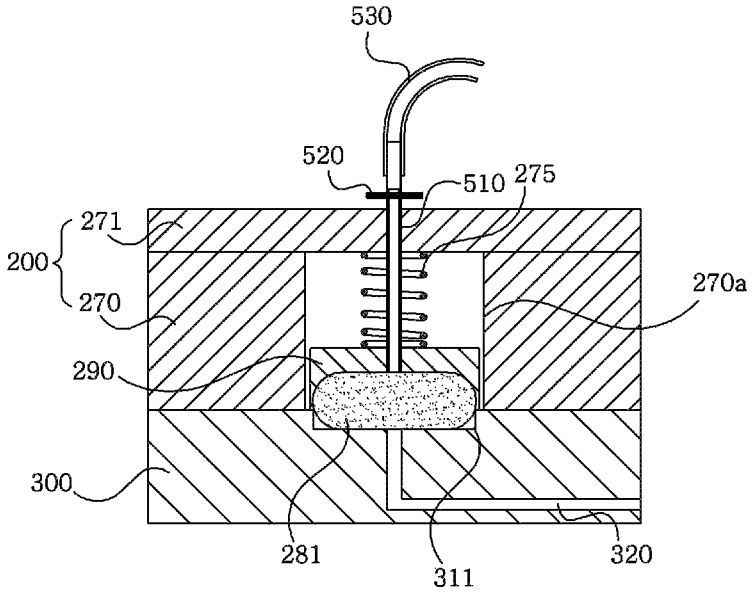
FIG. 6 is a conceptual partial cross-sectional view illustrating an O-ring assembly structure according to first and second exemplary embodiments of the present invention.
Figure 7:
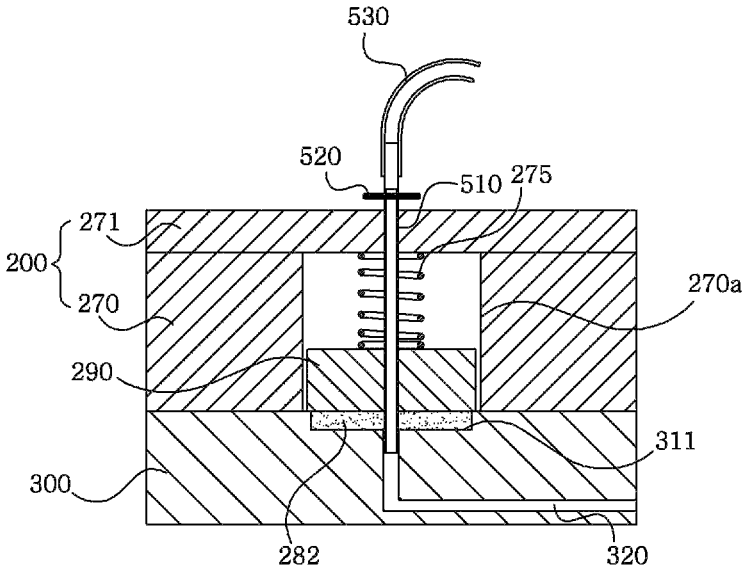
FIG. 7 is a conceptual partial cross-sectional view illustrating a flexible pad assembly structure according to first and second exemplary embodiments of the present invention.

FIG. 6 is a conceptual partial cross-sectional view illustrating an O-ring assembly structure according to first and second exemplary embodiments of the present invention, and FIG. 7 is a conceptual partial cross-sectional view illustrating a flexible pad assembly structure according to first and second exemplary embodiments of the present invention.

The air injection path provided at the micro-fluidic device (300) includes a groove (311) formed at the micro-fluidic device (300) and a fluid chamber (320) exposed to the groove (311), where the air injection path formed at the upper substrate (200) is configured in the shape of an O-ring assembly structure as illustrated in FIG. 6.

That is, the air injection path formed at the upper substrate (200) is formed with a groove (270*a*) opposite to the groove (311) formed at the micro-fluidic device (300), where the groove (270*a*) of the upper substrate is positioned with an air injection pipe (510) connected to an external air pump, and a periphery of the air injection pipe (510) is mounted with a coil spring (275) and a periphery of a distal end of the air injection pipe (510) is mounted with a support unit (290) and an O-ring (281).

The O-ring (281) is secured to the support unit (290), and the distal end of the air injection pipe (510) is exposed to the O-ring (281). Thus, in a case the upper substrate (200) is tightly brought into the micro-fluidic device (300), the O-ring (281) is depressed to the groove (311) of the micro-fluidic device (300) to block the groove (311), whereby the groove (311) of the micro-fluidic device (300) can maintain an air-tightness to prevent air from being introduced or to prevent air from being discharged to the outside. The external air pump performs pressing and vacuuming operations, whereby the fluid inside the fluid chamber of the micro-fluidic device (300) can be accurately and advantageously controlled.

An air injection path formed at the upper substrate (200) as another structure may be formed with a flexible pad assembly structure as illustrated in FIG. 7. The flexible pad assembly structure is such that the support unit (290) is secured by a flexible pad (282) and a distal end of the air injection pipe (510) is exposed to the flexible pad (282).

In some exemplary embodiments, the upper substrate (200) may be formed with a first substrate (270) formed with a through hole and a second substrate (271) connected to the first substrate (270) may be formed to form the groove (270*a*) on the upper substrate (200).

Furthermore, the air injection pipe (510) may be connected to an air pump by a flexible tube (320), and a periphery of an air injection pipe (510) region is mounted with a stopper (520) for restricting elasticity of the coil spring (275).

Figure 8A:
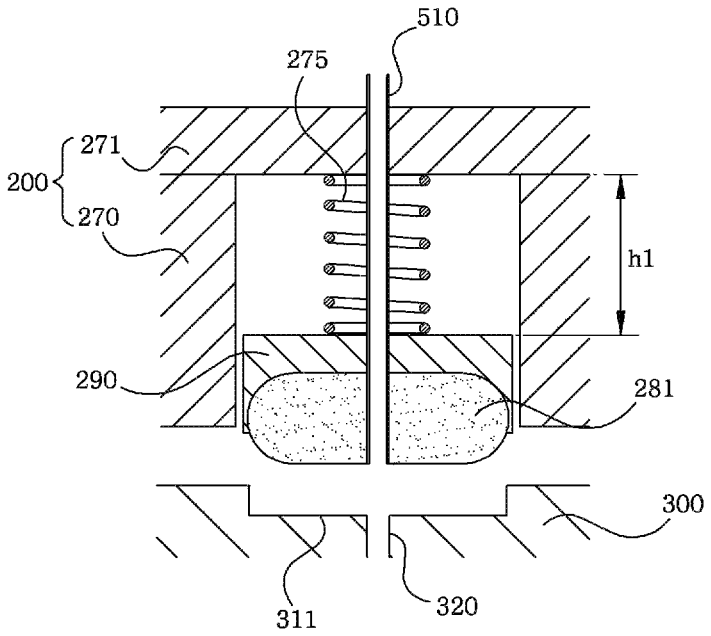
FIGS. 8*a* and 8*b* are conceptual partial cross-sectional views illustrating an O-ring assembly structure according to first and second exemplary embodiments of the present invention.
Figure 8B:
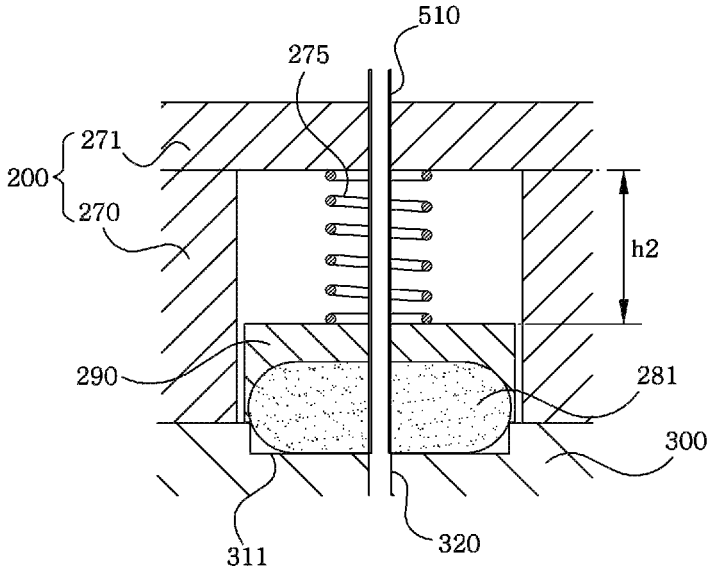

FIGS. 8*a* and 8*b* are conceptual partial cross-sectional views illustrating an O-ring assembly structure according to first and second exemplary embodiments of the present invention.

Referring to FIG. 8*a*, in a state where the micro-fluidic device is inserted between the upper and lower substrates, and the clamp is not operated, the upper substrate (200) is not tightly brought into contact with the micro-fluidic device (300). Therefore, the O-ring is positioned, being discrete from the groove (311) of the micro-fluidic device (300).

Thereafter, in a case the clamp is activated, the upper substrate (200) is air-tightly brought into contact with the micro-fluidic device (300), and the O-ring (281) is depressed to the groove (311) of the micro-fluidic device (300) to block the groove (311), as shown in FIG. 8*b*.

At this time, a length (h2) of the coil spring (275) in a state of FIG. 8*a* is shorter than a length (h1) of the coil spring (275) in a state of FIG. 8*b*, whereby the O-ring (281) is firmly brought into contact with the groove (311) of the micro-fluidic device (300) to maintain the air-tightness.

The previous description of the present invention is provided to enable any person skilled in the art to make or use the invention. Various modifications to the invention will be readily apparent to those skilled in the art, and the generic principles defined herein may be applied to other variations without departing from the spirit or scope of the invention. Thus, the invention is not intended to limit the examples described herein, but is to be accorded the widest scope consistent with the principles and novel features disclosed herein.

As apparent from the foregoing, the micro-fluidic system according to the present invention has an industrial applicability in that air-tightness between an air injection path of a micro-fluidic device and an air injection path of an upper substrate is realized by an O-ring assembly structure or a flexible assembly structure to prevent air from being introduced from outside or prevent air from being leaked out, whereby movement of fluid inside an fluid chamber in the micro-fluidic device can be accurately controlled by pressing and vacuuming operations of an external air pump.

What is claimed is:

1. A micro-fluidic system, the system comprising:

a lower substrate;

an upper substrate opposite to the lower substrate, the upper substrate including a first air injection path; and a micro-fluidic device interposed between the upper and lower substrates, the micro-fluidic device including a fluidic chamber filled with a fluid and a second air injection path corresponding to the first air injection path, wherein the second air injection path includes a first groove on the micro-fluidic device, wherein the first air injection path includes a second groove opposite to the first groove, and an air injection pipe is positioned through the second groove, wherein a coil spring is disposed on a side surface of the air injection pipe, wherein an O-ring is secured to a support unit, disposed at a distal end of the air injection pipe, configured to move with the support unit throughout displacement of the support unit and to block the first groove on the micro-fluidic device, and the size of the O-ring corresponds to that of the first groove, such that a maximum radial extent of the O-ring sits within the first groove, wherein the support unit is disposed on the O-ring and the support unit contacts with the O-ring, and wherein the fluidic chamber has a reaction region including at least one electrode which detects a degree of reaction with the fluid.

2. The micro-fluidic system of claim 1, further comprising fastening means fastening the upper and lower substrates, wherein the fastening means includes a clamp on the upper substrate and a groove at a lateral surface of the lower substrate.

3. The micro-fluidic system of claim 2, further comprising an elastic member between the clamp and the upper substrate.

4. The micro-fluidic system of claim 3, wherein the elastic member separates the micro-fluidic device from the upper and lower substrates.

5. The micro-fluidic system of claim 1, wherein the upper substrate includes at least two through holes, at least two guide posts and at least two bushes, each guide post being inserted into a corresponding through hole of the at least two through holes and secured to the lower substrate, and each guide post being inserted into a corresponding bush of the at least two bushes.

6. The micro-fluidic system of claim 5, wherein a ball bearing is interposed between each corresponding bush and guide post.

7. The micro-fluidic system of claim 1, wherein a periphery of the air injection pipe is mounted with a stopper for restricting elasticity of the coil spring.

8. The micro-fluidic system of claim 1, wherein the fluid inside the fluidic chamber of the micro-fluidic device includes biological materials.

9. The micro-fluidic system claim 1, wherein the at least one electrode includes a reference electrode, a counter electrode and a working electrode.

10. The micro-fluidic system of claim 1, wherein a gap between the upper and lower substrates is larger than a thickness of the micro-fluidic device.

* * * * *